United States Patent [19]

Barriquand et al.

[11] Patent Number: 4,545,135

[45] Date of Patent: Oct. 8, 1985

[54] INSTALLATIONS FOR SPIN-DRYING FIBROUS OR POROUS MATERIALS

[75] Inventors: B. Barriquand; F. Villard, both of Roanne; M. Martin; M. Tridon, both of Lyons; M. Pignal, Annonay, all of France

[73] Assignees: Barriquand, Roanne; Robatel, Genas, both of France

[21] Appl. No.: 489,121

[22] Filed: Apr. 27, 1983

[30] Foreign Application Priority Data

Apr. 29, 1982 [FR] France ..... 82 07407
Feb. 25, 1983 [FR] France ..... 83 03123

[51] Int. Cl.[4] ..... F26B 11/08

[52] U.S. Cl. ..... 34/58; 34/69; 34/105; 34/187; 68/20; 68/23 R; 68/210

[58] Field of Search ..... 34/8, 58, 69, 90, 105, 34/187; 68/20, 23 R, 210

[56] References Cited

U.S. PATENT DOCUMENTS

| | | | |
|---|---|---|---|
| 1,957,328 | 5/1934 | Engel | 34/105 |
| 1,973,953 | 9/1934 | Gordon | 34/58 |
| 2,058,368 | 10/1936 | Sunderland | 34/8 |
| 2,341,211 | 2/1944 | Denyssen | 34/58 |
| 3,732,993 | 5/1973 | Csapo | 34/242 |
| 4,205,461 | 6/1980 | Lovgren | 34/242 |

FOREIGN PATENT DOCUMENTS

| | | | |
|---|---|---|---|
| 668962 | 11/1938 | Fed. Rep. of Germany | 34/58 |
| 1159856 | 12/1963 | Fed. Rep. of Germany | 68/23 |
| 2732206 | 1/1978 | Fed. Rep. of Germany | 68/20 |
| 403205 | 12/1933 | United Kingdom | 34/58 |

*Primary Examiner*—Larry I. Schwartz
*Assistant Examiner*—David W. Westphal
*Attorney, Agent, or Firm*—Weiser & Stapler

[57] ABSTRACT

Installation for the centrifugal spin-drying or combined spin-drying and drying of fibrous or porous materials comprising, in combination, a spin-drier and a material carrier adapted to receive at least one pile of spools or similar of fibrous or porous materials, said material carrier being formed from a plurality of supports each adapted to receive a pile of spools or similar, disposed along at least one ring about a common axis formed by a central caisson, said spin-drier being equipped with a basket comprising a plurality of pockets or similar each adapted to receive a pile of spools or similar carried by a support of the material carrier, said supports being designed to be each housed in a pocket of the basket of said spin-drier and the common axis about which said supports are disposed in a ring being formed by a hollow central caisson adapted to fit into the central pivot of the centrifugal spin-drier.

35 Claims, 16 Drawing Figures

INSTALLATIONS FOR SPIN-DRYING FIBROUS OR POROUS MATERIALS

BACKGROUND OF THE INVENTION

1. Field of the Invention

The present invention relates to an installation for spin-drying the most diverse fibrous and porous materials and more especially to the spin-drying of fibrous textile materials after bleaching, dyeing treatments or any other treatment in an aqueous or solvent medium. The fibrous textile materials concerned by the present invention comprise essentially, but not in a limitative sense, such materials before they are spun (in the form of flock) while they are being spun (in the form of tops) or after they have been spun (in the form of threads), and even woven or knitted products. The invention is particularly adapted to the spin-drying of fibrous materials in the form of spools, such as spools of tops, obtained in the different steps of teasing out or carding the fibers from flocks or heaps of fibers.

2. Description of the Prior Art

Installations are known for spin-drying fibrous materials and in particular textile materials loaded loose or spool by spool into the spin-dryer.

However, because of their design which only allows this method of loading, these installations require time and labor consuming handling operations for loading the materials to be treated into the spin-dryer or for removing them therefrom.

Installations are also known for spin-drying fibrous materials, particularly textile materials, disposed in the form of piles of spools on a material carrier, this latter carrying the piles of spools to be treated not only in the enclosure where the bleaching of dyeing treatments take place but also in the spin-dryer, which means that it is transferable from said enclosure into the spin-dryer. The carriers proposed in the prior art are constructed, on the one hand, so as to withstand the centrifugal force to which they are subjected in the spin-dryer and, on the other hand, so as to maintain the piles of spools which they carry substantially vertical during spin-drying; to this end, the metal parts which they comprise have a considerable thickness to present an optimum resistance to the centrifugal force and the piles of spools are maintained vertical on the material carrier during spin-drying, by reinforcement belts with which the carriers are equipped. Such a design of spin-dryers using material carriers considerably reduces the handling operations required for loading and unloading the materials into and from the spin-dryer with respect to spin-dryers not using a material carrier.

However, these spin-drying installations present a number of drawbacks, the most important of which are represented by the fact that the known material carriers are heavy and rigid, to comply with the above-mentioned requirements and are therefore of a high cost price; furthermore, their high weight requires costly apparatus for handling them. Moreover, because of their very design, these rigid material carriers form an assembly whose maintenance and repair are difficult.

The present invention has consequently as its aim to provide an installation for spin-drying fibrous or porous materials which answers better the requirements of practice than the previously known installations relating to the same aim, particularly in that, because of its new design, it allows a considerable reduction in the cost of the material carriers, a considerable simplification in handling these latter and even the automation of the loading and unloading operations, and easier maintenance and repair possibilities.

SUMMARY OF THE INVENTION

The present invention provides an installation for spin-drying fibrous or porous materials which comprises, in combination, a spin-dryer and a material carrier adapted to receive at least one pile of spools of fibrous or porous materials, more especially a material carrier formed from a plurality of supports adapted each to receive a pile of spools, disposed in at least one ring about a common axis formed by a central caisson, which installation is characterized in that said spin-dryer is equipped with a basket comprising a plurality of pockets or similar, each adapted to receive a pile of spools carried by the material carrier, in that said supports are designed to be each housed in a pocket of the basket of the spin-dryer and in that the common axis about which said supports are disposed in a ring is formed by a hollow central caisson adapted to fit into the central pivot of the spin-dryer.

In an advantageous embodiment of the spin-drying installation according to the invention, the material carrier comprises at its base a so-called distribution caisson and each support is provided at its lower end with a centrally apertured disk which cooperates with an axial rod or similar fixed to the bottom of said caisson, which extends over the whole height of said support and is integral at its upper end with an assembly formed by a holding element pierced with an aperture for passing said rod therethrough, which is held in place by means of a nut or similar which is locked against said holding element.

According to an advantageous arrangement of the invention, said holding element comprises a plate which is applied to the upper end of the material carried by said support and which comprises an aperture for passing therethrough the upper end of the inner sleeve and of the axial rod, closed by a cap associated with a nut or similar for locking the upper end of the rod in position.

According to a preferred embodiment of the spin-drying installation of the invention, each support of the material carrier further comprises two concentric perforated cylinders—or sleeves—between which is disposed a pile of spools and in which said rod or cylinder forms the axis.

According to another preferred embodiment of the spin-drying installation of the invention, each support of the material carrier comprises a perforated cylinder—or single sleeve—in which said rod or similar forms the shaft and about which is disposed a pile of spools.

In accordance with the invention, the assembly formed by the base disk, the holding element and the axial rod, possibly advantageously associated with one or two sleeves, which assembly forms said support, forms a fairly flexible assembly which presses the fibrous or porous material carried by the support against the upper wall of the distribution caisson and allows lateral movement of each support within predetermined controlled limits, in the direction of the wall of the corresponding pocket of the basket of the spin-dryer in which it is housed, under the effect of the centrifugal force.

Whereas, in the preceding embodiment, the sleeves which form the supports for the piles of spools of the material carrier are integral with the base disk, so that the sleeves and the base disk move jointly laterally outwardly under the effect of the centrifugal force, during the spin-drying procedure, in accordance with an advantageous arrangement of the invention at least the inner sleeve of each support is not integral with the base disk, so that it moves laterally outwardly under the effect of the centrifugal force, during the spin-drying procedure, independently of the base disk so as to come into abutment against the fibrous material which it carries.

Also in accordance with the present invention, each of the supports of which the material carrier is formed, comprises at least one insert disk substantially parallel to the base disk, placed between the superimposed spools of a pile of spools carried by each support.

According to an advantageous embodiment of the spin-drying installation comprising a material carrier formed from a plurality of supports each adapted to receive at least one pile of spools, disposed in two or more concentric rings, this latter comprises at least one means for holding at least one ring of piles, adapted to confer on the piles of said ring a good resistance to the centrifugal spin-drying force and to avoid damage thereto.

According to an advantageous arrangement of this embodiment, said holding means is formed by a belt which may be perforated.

According to an advantageous feature of this arrangement, a belt is placed about the or each inner ring of piles.

According to another advantageous feature of this arrangement, a belt is positioned about the or each inner ring of piles and a belt is positioned about the outer ring of piles.

According to yet another advantageous feature of this arrangement, the belt or belts is/are provided with an appropriate locking device for the temporary interlocking thereof with the material carrier.

In such a case, once the spin-drying and the drying are finished and before the material is removed from the material carrier, it is necessary to unlock the belt of belts so as to allow removal thereof from the material carrier.

According to another advantageous feature of this arrangement, the belts for holding the or several inner rings of piles and possibly the peripheral ring are interlocked so as to form a unit assembly such as a whiffletree belt assembly.

According to yet another advantageous feature of this arrangement, the holding belt or belts are irremovably locked to the material carrier.

According to another advantageous arrangement of the invention, said holding means is formed by at least one disk comprising apertures for receiving the piles of one or more concentric rings.

As a variation, the spin-drying installation of the invention may be equipped both with at least one holding belt and with at least one disk for holding and centering the piles of at least one ring.

The positioning, in the spin-drying installation of the invention, of means for holding the piles of an inner ring or several concentric rings allow the piles to withstand the centrifugal force, thus avoiding damage thereto. The positioning of holding belts about the piles of the inner ring or rings allows the spools which form the piles of said ring or rings to bear, by translation. against the belt or belts during centrifugation, thus allowing them to withstand the centrifugal force and not to be damaged.

The positioning of a holding belt about the peripheral ring of piles avoids having to position a holding belt in the basket of the spin-dryer.

The holding and centering disk or disks is/are positioned in the material carrier at the time of loading the spools into this latter and receives or receive, in the apertures which are formed therein, the piles of spools of material to be spin-dried, thus reducing their span or reach and consequently bending thereof when they are urged by the weight of the spools subjected to the centrifugal effect.

According to another advantageous embodiment of the spin-drying installation of the present invention, in which the material carrier is formed from a plurality of supports for the material to be spin-dried, disposed in two or more concentric rings, said supports are formed by two or more rings of tubes each intended to receive a load of material to be spin-dried, the tubes of the outer ring being housed, during the centrifugal spin-drying operation, in the pockets of the basket and the tubes of the or each inner ring coming the pockets formed on the material carrier by a succession of disks spaced apart on carrier rods.

According to an advantageous embodiment of the spin-drying installation of the present invention, this latter comprises means adapted for allowing drying at the same time as spin-drying of material contained in said spin-drying installation, which means comprise means for introducing and causing to circulate a gaseous drying fluid in the spin-drying installation, means for orientating the flow direction of the drying fluid in the spin-drying installation and means adapted to ensure sealing of the spin-drying installation, which cooperate with the means for orientating the direction of flow of drying fluid so as to allow flow of said fluid in the spin-drying installation repsectively during the centrifugal rotation of said installation and when said installation is stopped.

According to an advantageous embodiment of the means adapted to provide drying at the same time as spin-drying, they comprise first sealing means which ensure sealing of the spin-drying installation during rotation thereof and second sealing means which provide sealing of said installation when stopped.

According to an advantageous arrangement of this embodiment, the first sealing means are formed by hydraulic seals associated with the connection of the drying fluid introduction meas.

According to another advantageous arrangement of this embodiment, the second sealing means are formed by inflatable tores.

According to another advantageous embodiment of the means adapted to provide drying at the same time as spin-drying, they further comprise means for boosting the pressure of the drying fluid.

According to yet another advantageous embodiment of the means adapted for providing drying at the same time as spin-drying, they further comprise means adapted to place the drying fluid under a reduced pressure.

In accordance with the invention, the means for causing the drying fluid to flow are formed, in combination, by a pressure boosting or depressurizing device and by the rotational drive of the spin-drying installation.

According to another advantageous embodiment of the means adapted to provide drying at the same time as spin-drying, the means for orientating the flow direction of the drying fluid are formed by a plurality of flaps movable in two positions, mounted on a pivoting shaft, and disposed in the drying fluid introduction means.

According to another advantageous embodiment of the invention, the means for introducing the drying fluid into the spin-drying installation emerge at the bottom thereof, in the distribution caisson thereof.

According to another advantageous embodiment of the invention, the means for introducing the drying fluid into the spin-drying installation emerge in the cover of this latter.

According to yet another advantageous embodiment of the invention, the means adapted for providing drying at the same time as spin-drying further comprise means for removing the humidity loaded drying fluid from the spin-drying installation, which fluid removal means communicate with the means for introducing and circulating said fluid for the recirculation of said fluid, in these latter, possibly after having passed through a condenser and through pressurizing or depressurizing means.

The spin-drying/drying installation of the present invention provides spin-drying and drying of the fibrous textile materials mentioned in the preamble, as well as the spin-drying and drying of textile products in the form of flock, as well as the spin-drying and drying of any porous products.

The present invention also relates to a process for centrifugal spin-drying and drying of fibrous and porous materials, which consists in causing a spin-dryer to rotate containing materials to be spin-dried and dried, equipped with hydraulic seals and inflatable toric seals, in introducing a gaseous drying fluid into said spin-drier and causing it to flow through the material contained in this latter by the action of flow means formed by a fan and by the centrifugal rotation of the spin-drier, said centrifugal rotation resulting in accelerating the flow of the drying fluid through the material and said flow taking place, inside the spin-drier, from the center to the periphery, in the direction of the centrifugal effect.

According to a preferred implementation of the process of the invention, the flow direction of the drying fluid is reversed to go from the periphery to the center of the material contained in the spin-drier, when the rotation of the spin-drier is stopped, so as to make the drying uniform.

According to another implementation of the process of the invention, the drying fluid is a hot gaseous fluid.

According to yet another implementation of the process of the invention, the drying fluid is cold gaseous fluid.

In accordance with the invention, the drying fluid flows under pressure.

According to another advantageous arrangement of the invention, the drying fluid flows by suction, under reduced pressure.

According to the invention, the pockets of the spin-drier basket have an appropriate cross-section and more especially a circular or polygonal cross-section.

The spin-drier basket comprising a plurality of pockets having an appropriate cross-section in accordance with the invention is adapted to be used for the treatment of materials other than fibrous or porous materials, in which case the pockets of the basket are adapted to receive more especially containers loaded with metal pieces, waste or other solid materials.

In accordance with an advantageous arrangement of the invention, loading of the fibrous or porous material on to the material carrier is carried out at the loading station by means of a centering device formed by a trough whose diameter is substantially equal to the diameter d of the material carrier and whose upper part is widened out in the form of a cone to a diameter slightly greater than the inner diameter D of the basket of the spin-drier, which centering device is adapted to receive the distribution caisson which forms the base of the material carrier and to cooperate with a stop integral with the upper wall of said caisson, for controlling the diameter of the piles of spools loaded on the material carrier and to reduce it to the diameter d of the material carrier, before this latter is introduced into a treatment enclosure.

The spin-drying or spin-drying and drying installation of the present invention further comprises a device for unloading the spin-dried or spin-dried and dried material from the material carrier, which applies more particularly to the embodiment of the material carrier which comprises tubes for each receiving a load of material to be spin-dried, or spin-dried and dried, which unloading device comprises at least one cylinder and piston device which carries at its upper end a plate on which are placed thrust rods—whose number is preferably equal to that of the tubes of the material carrier—this unloading device cooperating with the material carrier, by introduction of the thrust rods into this latter through tubed holes provided substantially at right-angles to the axes of the above-mentioned tubes, these tubes being themselves equipped with bottoms formed by pusher disks adapted to move with a rising movement in said tubes, under the action of said thrust rods, to remove the material contained in said tubes.

In addition to the preceding arrangements, the invention comprises other arrangements which will be clear from the following description.

The present invention relates more particularly to installations for centrifugal spin-drying and spin-drying/drying of fibrous or porous materials, in accordance with the preceding arrangements, as well as the means adapted for construction and use thereof, and the overall installations comprising said centrifugal spin-drying and centrifugal spin-drying/drying installations.

BRIEF DESCRIPTION OF THE DRAWINGS

The invention will be better understood from the complement of description which follows which refers to the accompanying drawings in which:

FIG. 6 is a detail view, in partial cross section, of the basket of the centrifugal spin-drier, of which

FIG. 3 shows, also in an enlarged vertical section, another variation of a spool support which forms part of the material carrier;

Figure 1:
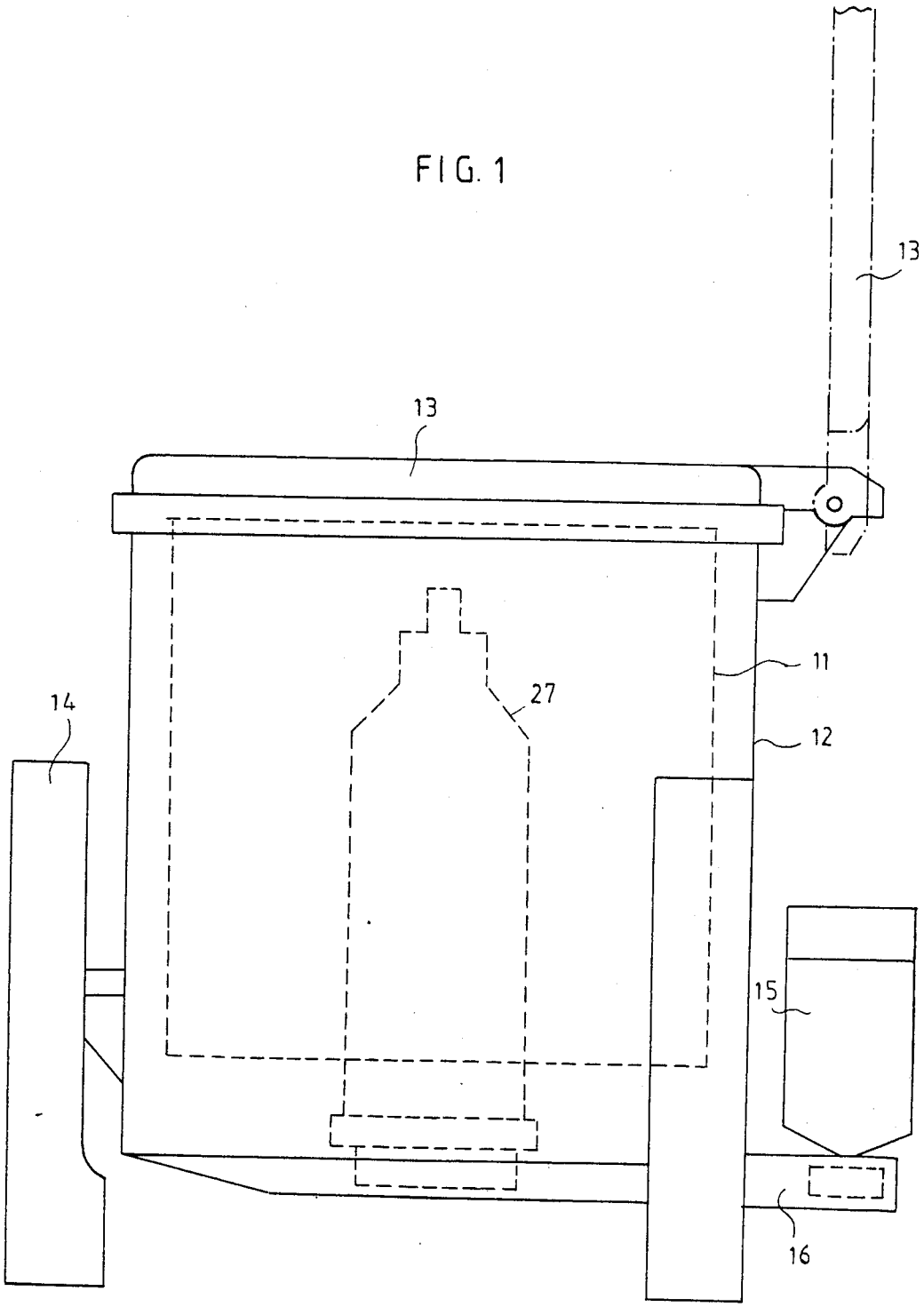
FIG. 1 is a schematical view in vertical section of a centrifugal spin-drier in accordance with the invention.
Figure 2:
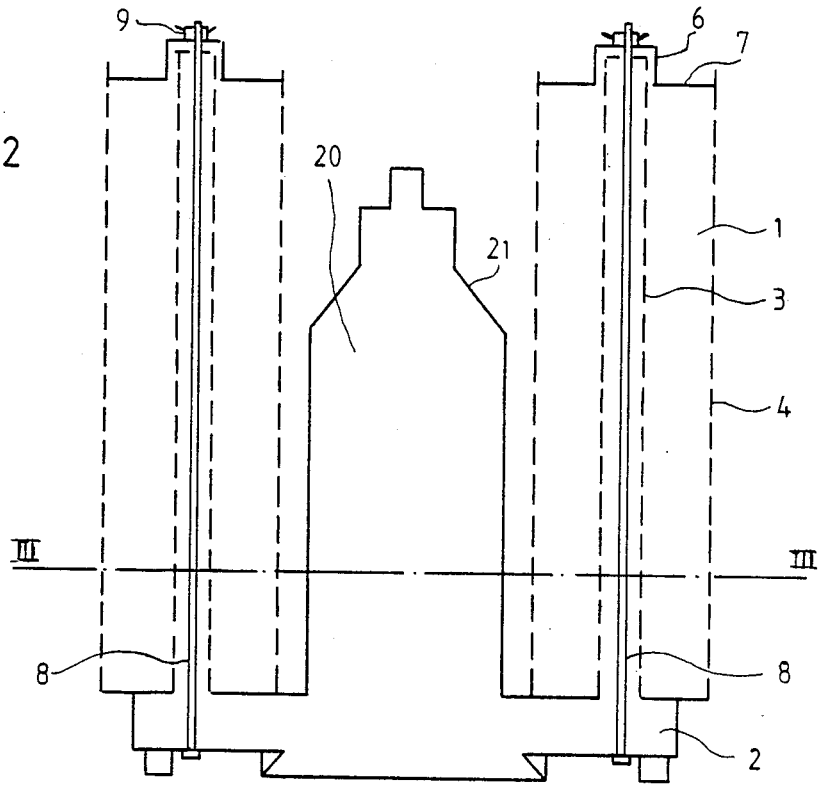
FIG. 2 is a schematical view in vertical section of a material carrier in accordance with the invention.

It will of course be understood that these drawings and the corresponding descriptive parts are given solely by way of illustration of the subject of the invention, of which they form in no wise a limitation.

DESCRIPTION OF THE PREFERRED EMBODIMENTS

The material carrier according to the invention comprises a plurality of supports adapted to receive the fibrous or porous material in the form of a pile of spools 1 and disposed in a ring on a distribution caisson 2 and about a central hollow caisson 21 in which space 20 is designed to fit into the central pivot 27 of a centrifugal spin-drier which will be described further on.

Each support comprises a perforated inner sleeve 3 and a perforated outer sleeve 4 which are concentric and between which the pile 1 of material to be treated is inserted, which is pressed against the upper wall 25 of caisson 2 by an assembly comprising an axial rod 8, an upper end plate 7 carrying a cap 6 which bears a nut, pin, key or similar 9, for locking the upper end of rod 8, whose lower end is fixed by any appropriate means, such as a screw for example to the bottom 26 of caisson 2, this assembly cooperating, for compression of pile 1 against the upper wall 25 of the caisson, with a disk 17 applied against said wall 25.

According to a variation specially designed for the treatment of piles of spools of cotton or polyester, each support may comprise only the inner sleeve 3 associated with the base disk 17-rod 8-upper end plate 7-cap 6-locking nut 9 assembly, in which case the pile of spools is fitted on to said sleeve 3; according to another advantageous variation, the support is without sleeves and comprises simply said assembly 17-8-7-6-9, in which case the pile of spools is fitted on to rod 8.

Figure 3:
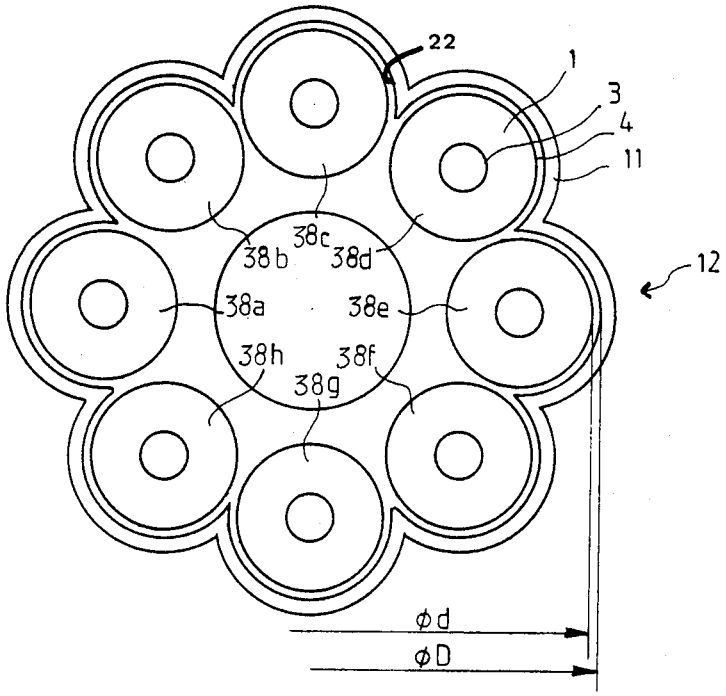
FIG. 3 is a schematical view in cross section along III—III of FIG. 2 of the material carrier disposed in the basket of the centrifugal spin-drier in accordance with the invention.
Figure 8:
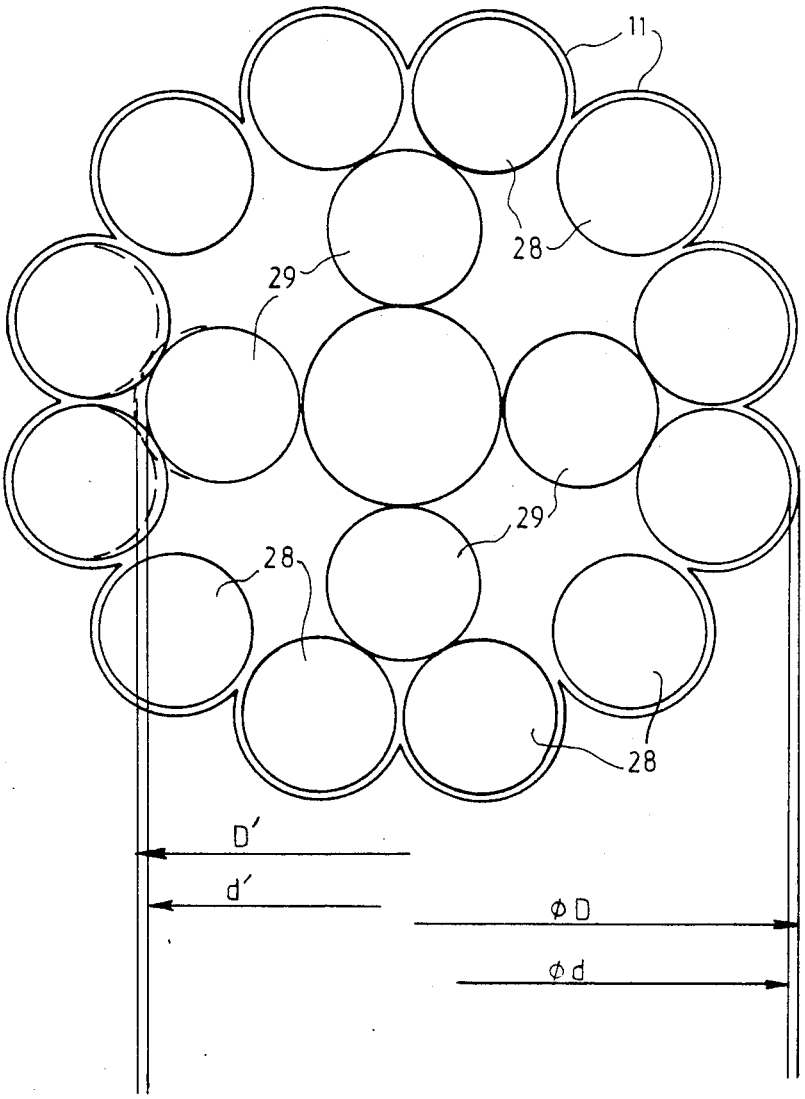
FIG. 8 is a cross sectional view of an embodiment of the material carrier comprising two concentric rings of supports for piles of spools.

In the embodiment shown in cross section in FIG. 3, the material carrier comprises a single ring of supports, whereas in the embodiment shown in cross section in FIG. 8, the material carrier comprises two concentric rings of supports 28 and 29.

It should be noted that the material carriers in accordance with the invention specially adapted to spin-drying fibrous or porous materials, as will be described further on, are adapted to carry said materials during the whole of the treatments to which they are likely to be subjected, and more especially during successive bleaching, dyeing, centrifugal spin-drying and drying treatments to which these materials are subjected, so that these latter may undergo a complete treatment cycle, which only requires a single operation for loading on to the material carrier and a single operation for unloading therefrom, once the treatment cycle has finished. In the two treatment steps comprising a gaseous or liquid fluid flow, caisson 2 plays the role of a caisson for distributing the treatment baths or the drying gas through the piles of material 1.

The material carrier in accordance with the invention is essentially intended to be introduced into a centrifugal spin-drier (see FIG. 1) which comprises a tank 12 suspended from three legs 14 and closed by a lid 13, containing a basket 11 for receiving the material carrier; basket 11 is rotated by motor 15 and the transmission 16. Basket 11 comprises a plurality of pockets 22 each of which forms a housing for a corresponding pile support 1 of the material carrier, the diameter d corresponding to the outer diameter of the material carrier defined by the outer sleeves 4 and diameter D being the maximum inner diameter of basket 11 including the pockets 22. In the spin-drying position, caisson 2 of the material carrier rests on the bottom of basket 11 of the spin-drier.

In the case where the material carrier comprises two or more concentric rings of supports, only supports 28 of the outer ring are received in the pockets 22 of basket 11, the supports 29 of the inner ring fitting between the adjacent supports of the outer ring and so on if the material carrier comprises more than two concentric rings.

Figure 4:
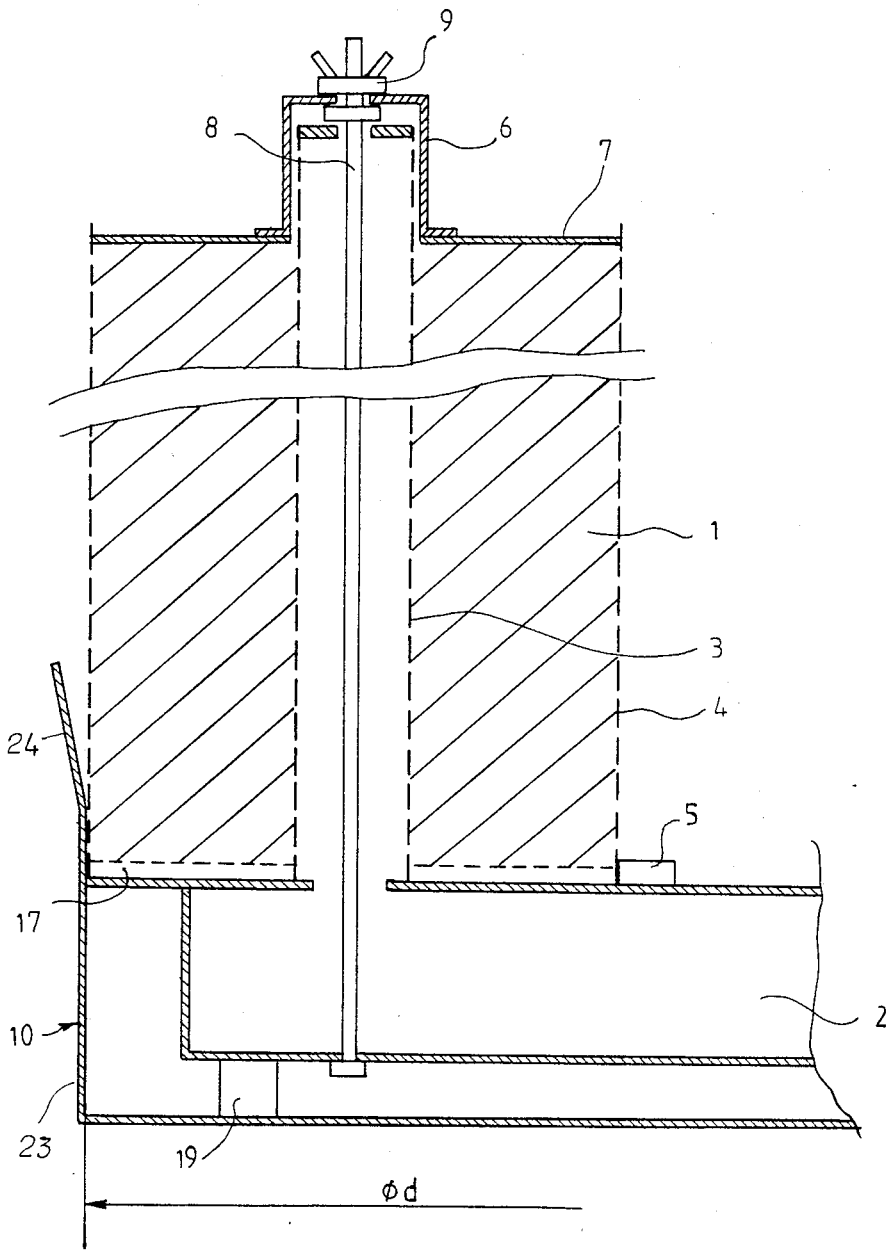
FIG. 4 is a schematical view in vertical section of a pile of spools in the loading station.

Before introducing the material carrier into the spin-drier, the material carrier is loaded with material at a loading station equipped with a centering device which will be described with reference to FIG. 4. The centering device 10 comprises a substantially cylindrical trough 23 whose diameter is substantially equal to that d of the material carrier, and which is widened out in the form of a cone 24 at its upper part. The material carrier loaded with material is gradually lowered into trough 23 in which its diameter is reduced to d, the downward travel of caisson 2 of the material carrier into trough 23 being limited by a stop 19 which is, in the present case, integral with the bottom of the trough, but which may be integral with the bottom 26 of the caisson. The centering device 10 cooperates with a stop 5 integral with the upper wall of caisson 2 for centering all the piles 1 within the limits of diameter d, by engagement of said stop with the assembly formed by the outer sleeve 4, the inner sleeve 3 and the base disk 17.

The material carrier reduced to diameter d is then positioned in basket 11 of the spin-drier, each pile of material 1 being housed in a pocket 22 of the basket 11 of the spin-drier (see FIG. 3 which represents by way of non limiting example the arrangement of the material in 8 piles 38*a* to 38*h*, the number of piles being variable depending on the dimensions of the material carrier or of the piles.

After being positioned in basket 11, the material carrier may, if so desired, be locked in position by means of a connection with caisson 21, although such locking is not indispensable.

Figure 5:
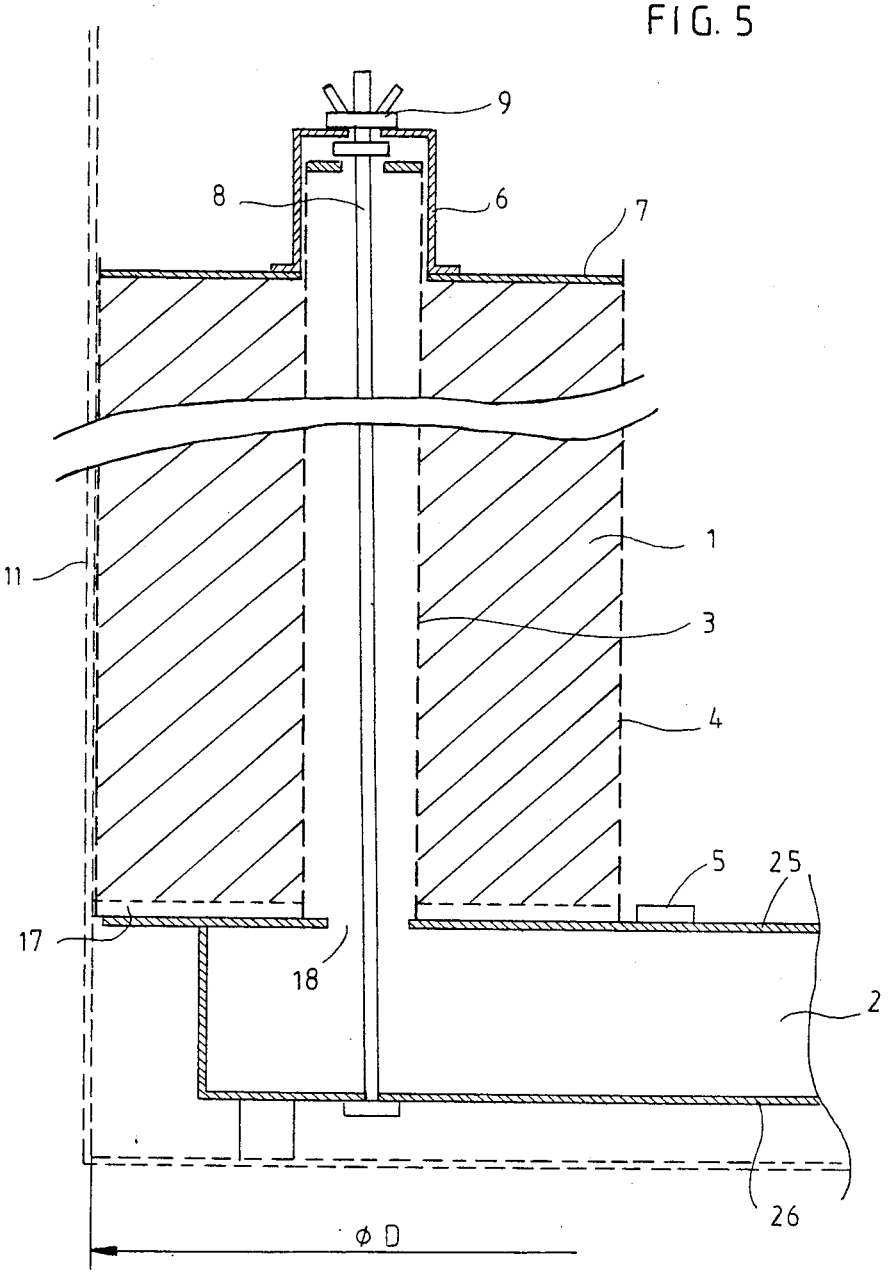
FIG. 5 is a schematical view in vertical section of a pile of spools during centrifugal spin-drying.
Figure 7:
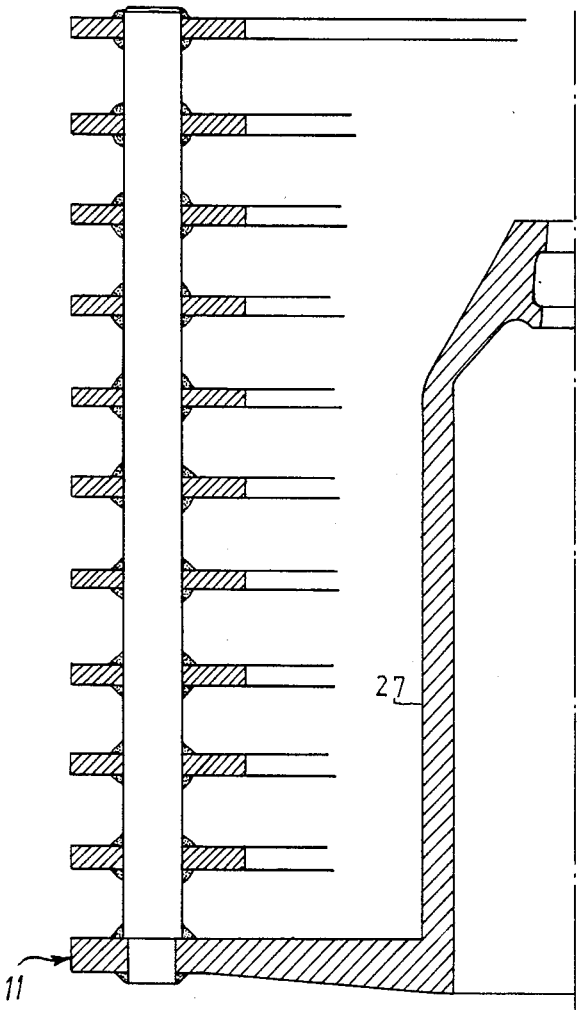
FIG. 7 is a vertical sectional view along VII—VII of FIG. 6.
Figure 6:
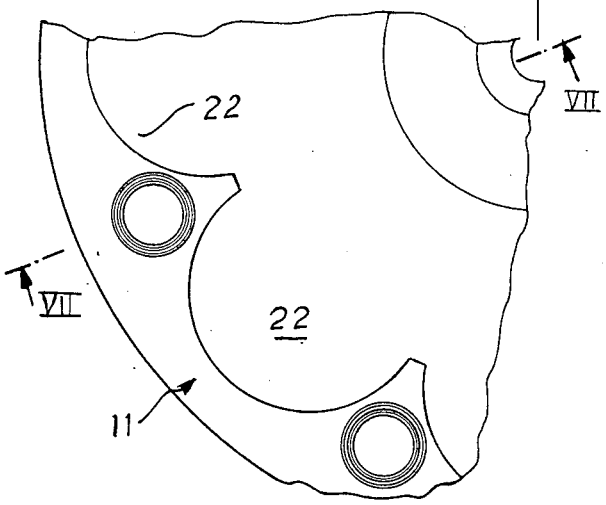

It should be noted that caisson 2 and stop 5 form fixed elements of the material carrier, whereas sleeves 3–4 and the base disk 17 are movable with respect to caisson 2. Thus, during spin-drying, under the effect of the centrifugal force, the assembly formed by the piles of material 1, supported by the inner 3 and outer 4 sleeves, and held in place by disk 17, plate 7, rod 8, cap 6 and the nut or similar 9, undergoes a lateral outward movement, in the direction of the internal part of the corresponding pockets against which each of the piles is jammed in abutment. Because of this slight lateral movement, which has been shown in FIG. 5, rod 5 tilts slightly for it is fixed at its lower end to the bottom of the distributing caisson whereas it is urged outwardly at its upper end, which gives it a slight outward tilt at its upper end, whereas the distance between the inner sleeve sleeve 3 and the outer sleeve 4 is always maintained constant because of the arrangement of the base disk 17 and the upper end plate 7. The lateral movement which the assemblies carrying piles 1 undergo takes place over a distance equal to the difference between the two diameters D and d. The aperture 18 formed in the base disk 17 is calculated so that, even after this movement, it is always inscribed in the inner circle of the inner sleeve 3.

Once the centrifugal spin-drying is finished, the material carrier may be removed from the basket of the spin-drier and drying may take place in a drier with a gas flow, generally hot air, through the material, either in the direction from the inner sleeve to the outer sleeve, or in the reverse direction, or by any other drying method.

As a variation, drying following centrifugal spin-drying may be provided in the centrifugal spin-drier by introducing drying gas therein, such as air which may be heated, or by application of an appropriate pressure or depression therein, the drying means being distributed through the material by means of caisson 2.

Figure 9:
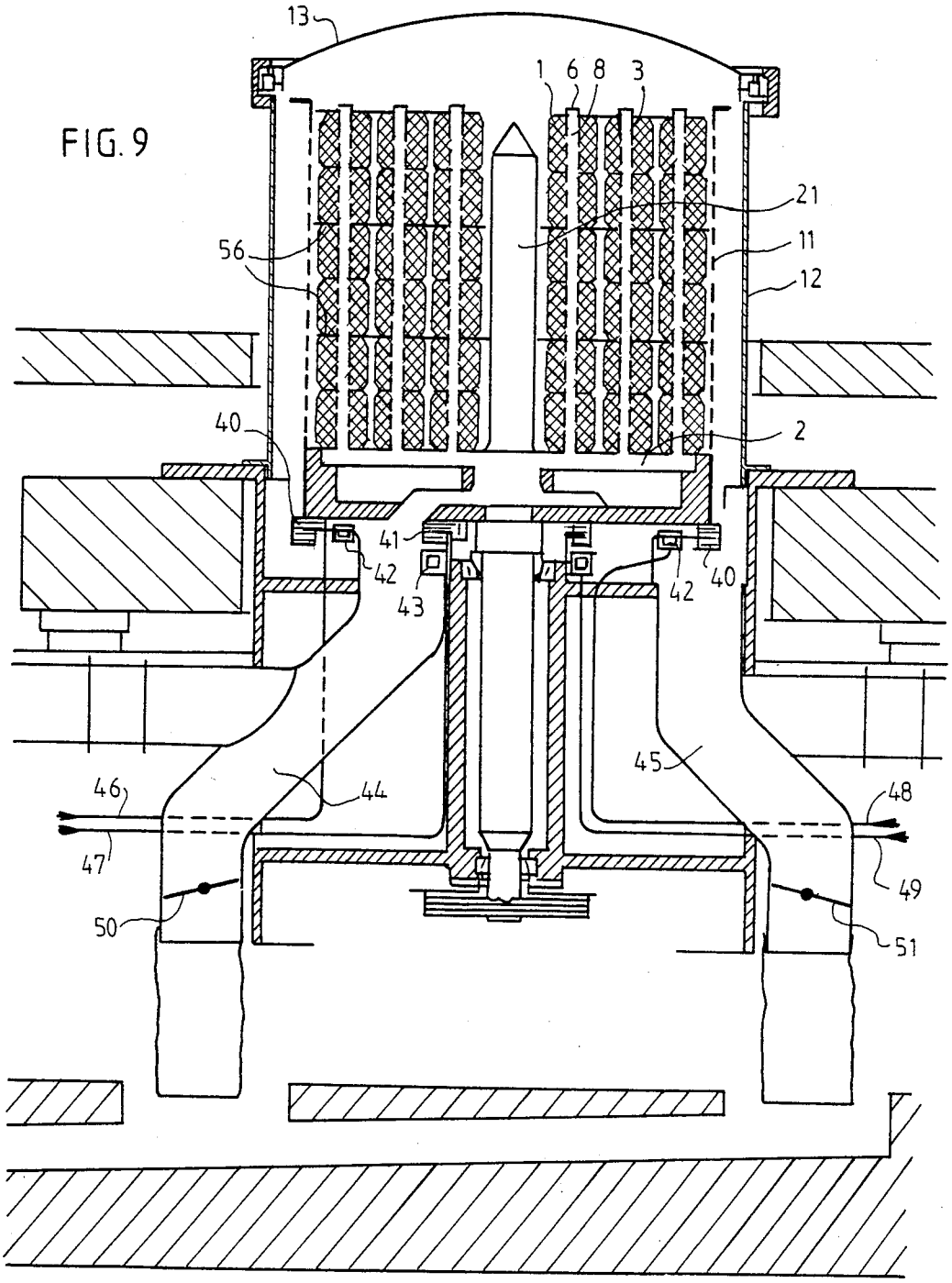
FIG. 9 is a vertical cross sectional view of a spin-drying or spin-drying/drying installation according to the invention, equipped with centering and holding disks also in accordance with the present invention.
Figure 10:
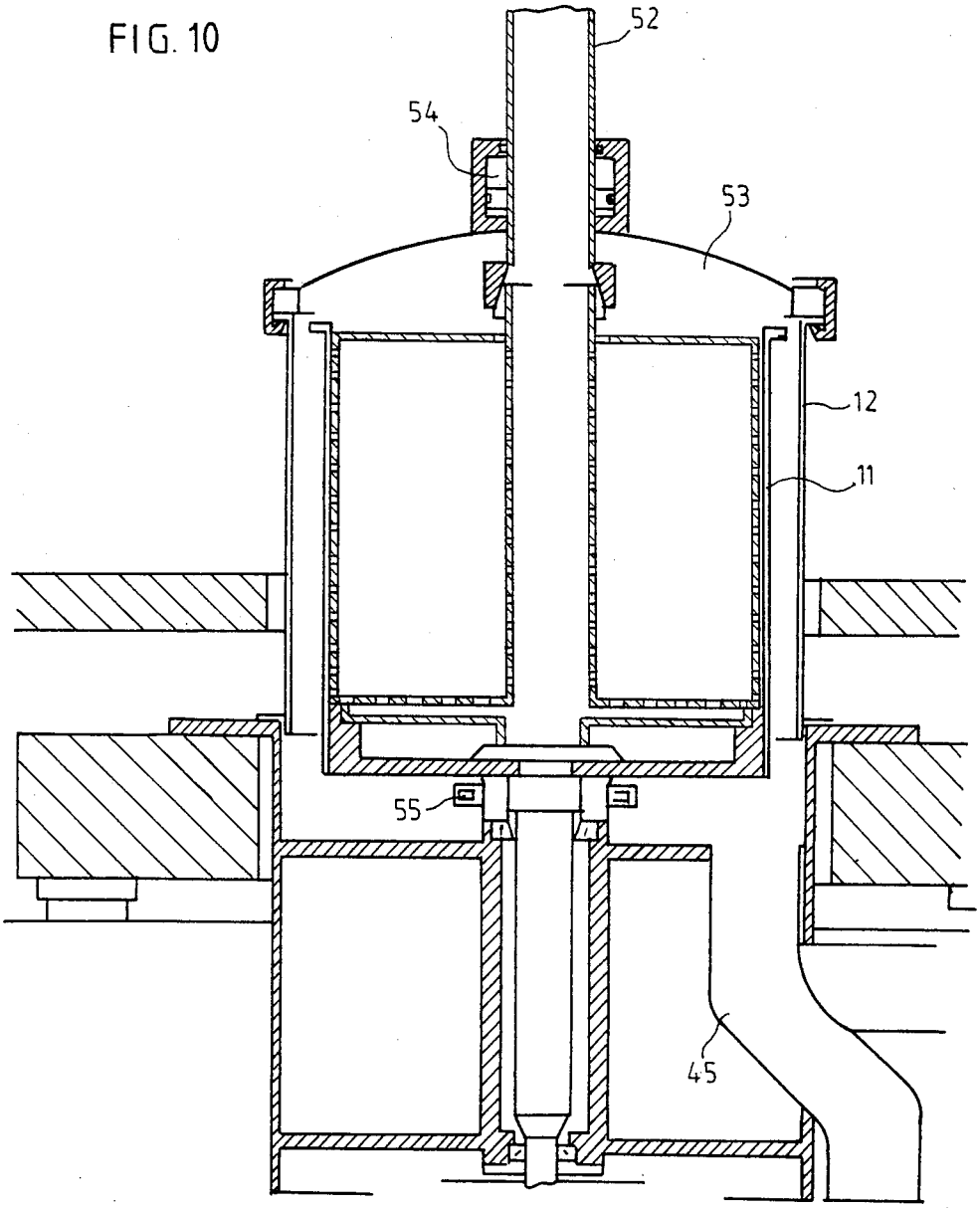
FIG. 10 is a vertical cross sectional view of another embodiment of the spin-drying or spin-drying/drying installation in accordance with the present invention.
Figure 11:
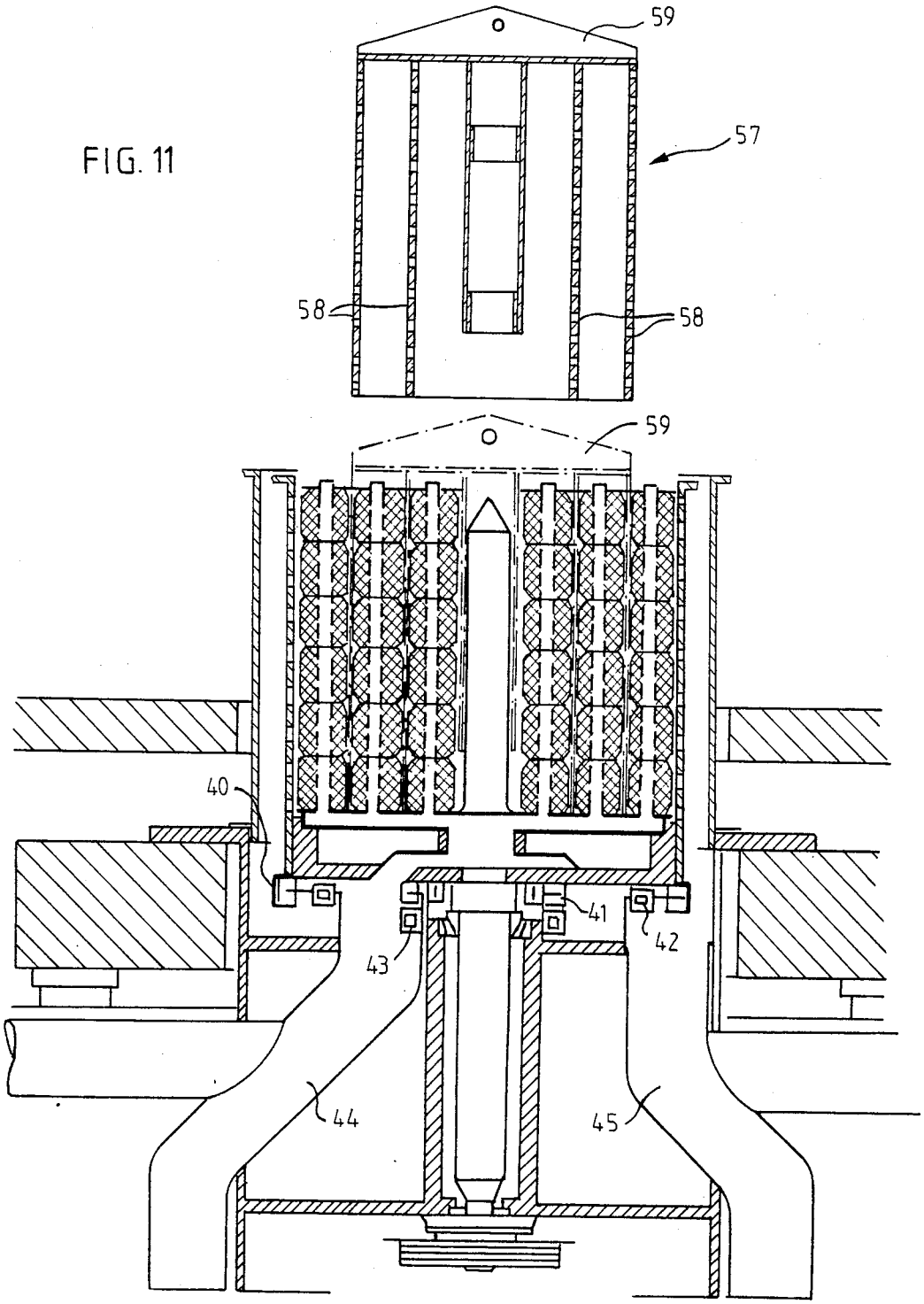
FIG. 11 is a vertical cross sectional view of a spin-drying or spin-drying/drying installation similar to that of FIG. 1, equipped with belts for holding the rings of piles of material to be treated.

In accordance with the invention, the spin-drying installation shown in FIGS. 9 to 11 is equipped with means for introducing a gaseous drying fluid, such as air for example, and causing it to flow in the spin-drier, during the spin-drying operation, when the spin-drier is rotating so as to cause the drying fluid to flow through the material, during spin-drying, so as to take advantage of the centrifugal force for accelerating the flow of the drying fluid through the spools carried by the material carrier from the center to the periphery of the material and of the spin-drier and thus accelerating drying of the material.

Once the spin-drying is finished and rotation of the spin-drier has stopped, the flow of drying fluid is reversed so that it takes place from the periphery towards the center, in order to make uniform and complete the drying of the material.

Such a drying procedure is made possible because of the arrangement of seals which ensure sealing of the spin-drier at the level of the mechanical parts and connections of the spin-drier with ducts for introducing and discharging the drying fluid.

Thus the spin-drier is provided at its base with two hydraulic seals 40,41 and two inflatable toric seals 42,43, respectively at its connection with the mechanical parts for rotational drive and at its connection with ducts 44 and 45 for the flow of the drying fluid.

The hydraulic seals 40, 41 provide the sealing for the rotating spin-drier. The drying fluid is then admitted into the spin-drier through duct 4 from which it flows, passing through the distribution caisson 2 into the center of the spin-drier, from where it flows towards the periphery while passing through spools 1. The drying fluid flow is accelerated by the centrifugal effect exerted by rotation of the spin-drier. The drying fluid leaves the spin-drier through duct 45.

The drying fluid fed into the spin-drier may be a hot or cold fluid and the flow thereof is achieved by application of pressure or suction, under a reduced pressure. Ducts 44 and 45 advantageously form a closed circuit in which are advantageously included pressurizing or suction means, possibly means for heating the fluid and means for condensing the humidity contained in the drying fluid discharged from the spin-drier, such as a cyclone for example (not shown).

The hydraulic seals 40,41 are fed with water by pipes 46,47 respectively, the water flowing through duct 45 in the case of an overflow.

When the centrifugal spin-drier is rotating, the drying fluid flows therein, from duct 44, in a direction which goes from the center towards the periphery, in the direction of the centrifugal force; thus, an increase of the migration of the humidity contained in the material is obtained towards the periphery of the spin-drier.

When the spin-drier stops, the central drying fluid supply through duct 44 is stopped. The hydraulic seals 40,41 are drained; to maintain the sealing of the circuit, the toric seals 42,43 are inflated by means of compressed air (at 5.7 bars for example) fed through pipes 48,49. The drying fluid supply is not stopped; its flow direction is reversed: it enters through duct 45 and flows from the periphery towards the center of the spin-drier to complete the drying.

Reversal of the flow direction of the drying fluid is provided by actuating reversal flaps 50 and 51 with two all or nothing positions, mounted respectively in duct 44 and in duct 45 and flaps mounted respectively in the by-pass at the outlet of the pressurizing means or at the input of the suction means, depending on whether the flow of the drying fluid takes place under pressure or under a reduced pressure, and at the level of the connection of ducts 44 and 45 with a duct leaving a fluid heating battery, if such is provided in the circuit.

Whereas in FIG. 9 the rotating spin-drier is fed with drying fluid through duct 44 which opens into the base of the spin-drier, in the embodiment shown in FIG. 10 the drying fluid supply is provided at the center of the spin-drier by means of a duct 52 which opens into the center of lid 53. In this embodiment, the rotational seal is provided by the hydraulic seal 54 provided at the position where duct 52 passes through lid 53, and sealing when stopped is provided by the inflatable toric seal 55 mounted at the connection of the spin-drier with the frame containing the mechanical parts for rotating the spin-drier and the base thereof. The drying fluid leaves the spin-drier, as in the embodiment shown in FIG. 9, through duct 45 and reversal of the fluid flow from outside towards the inside, i.e. coming from duct 45 towards the center of the spin-drier to leave through duct 51 takes place, when stopped, as described with reference to FIG. 9.

The flow of drying fluid through the material to be treated, during spin-drying thereof, results in reducing considerably the drying time and consequently the consumption of energy, and in doing away with the need for a drier, which becomes useless since the drying is carried out practically simultaneously with the spin-drying, except for the final phase of making the drying uniform.

After drying, the material is removed from the material carrier by removing the screw 9—cap 6—washer 7 assembly, by raising the outer sleeve 4 with a mechanical means such as hoist for example and thus raising material 1 by means of the outer 4 and inner 3 sleeves and disk 17 integral with sleeves 3 and/or 4. It is then sufficient to retract disk 17 to recover the material. Another unloading method consists in raising sleeve 3 by means of an appropriate mechanical means, such as a hoist for example, thus extracting material 1 by means of sleeves 3 and/or 4 and disk 17 integral with sleeves 3 and/or 4. It is also possible to raise, by a mechanical means, the integral sleeve 3—sleeve 4—disk 17 assembly carrying the material and in unloading this latter by tipping up the assembly.

The spin-drying installation shown in FIG. 9 further comprises holding and centering disks 56 in which are formed apertures through which pass the support tubes for spools 1. These disks reduce the span, and so the bending of these tubes when they are urged by the weight of spools 1 subjected to the centrifugal force, when the centrifugal spin-drier is rotating, which avoids deformation of the spools during spin-drying.

FIG. 11 shows a belt "whiffle-tree" assembly 57, associated with spin-drying/drying installations such as described with reference to FIG. 9. Belts 58 are perforated sleeves carried by a whiffle-tree 57. In the embodiment shown, the belts are positioned about an intermediate ring of piles, that is to say a ring of piles not situated at the periphery, which bears against belts 58, by translation, during spin-drying by centrifugation. These belts 58 may be introduced, before the spin-drying operation, by means of whiffle-tree 59 and locked to the material carrier. However, instead of being removable, as in the embodiment shown in FIG. 11, they may be integral, by welding for example, with the material carrier.

Figure 12:
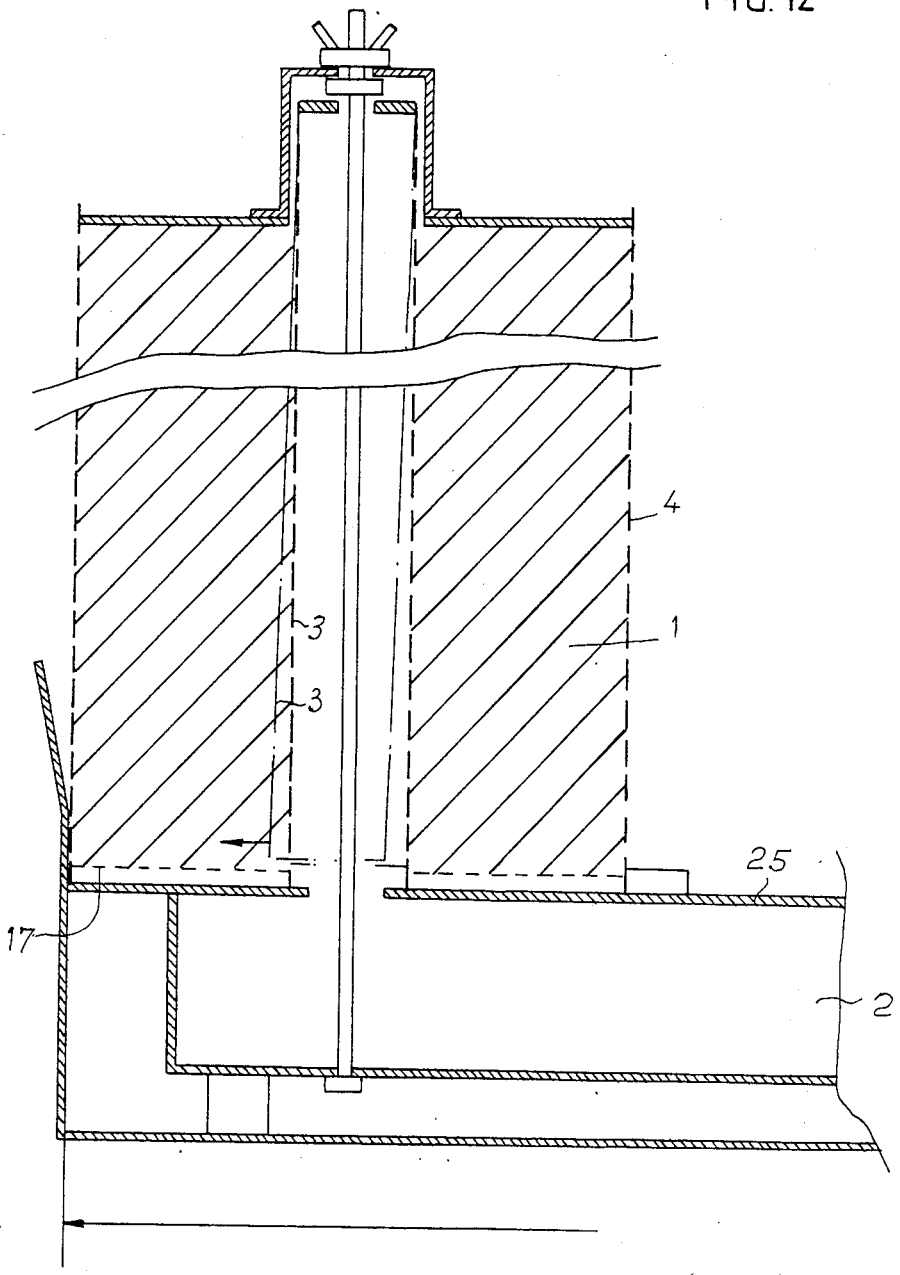
FIG. 12 is an enlarged view in vertical section of a spool support which forms part of the material carrier, according to a variation in accordance with the present invention.
Figure 13:
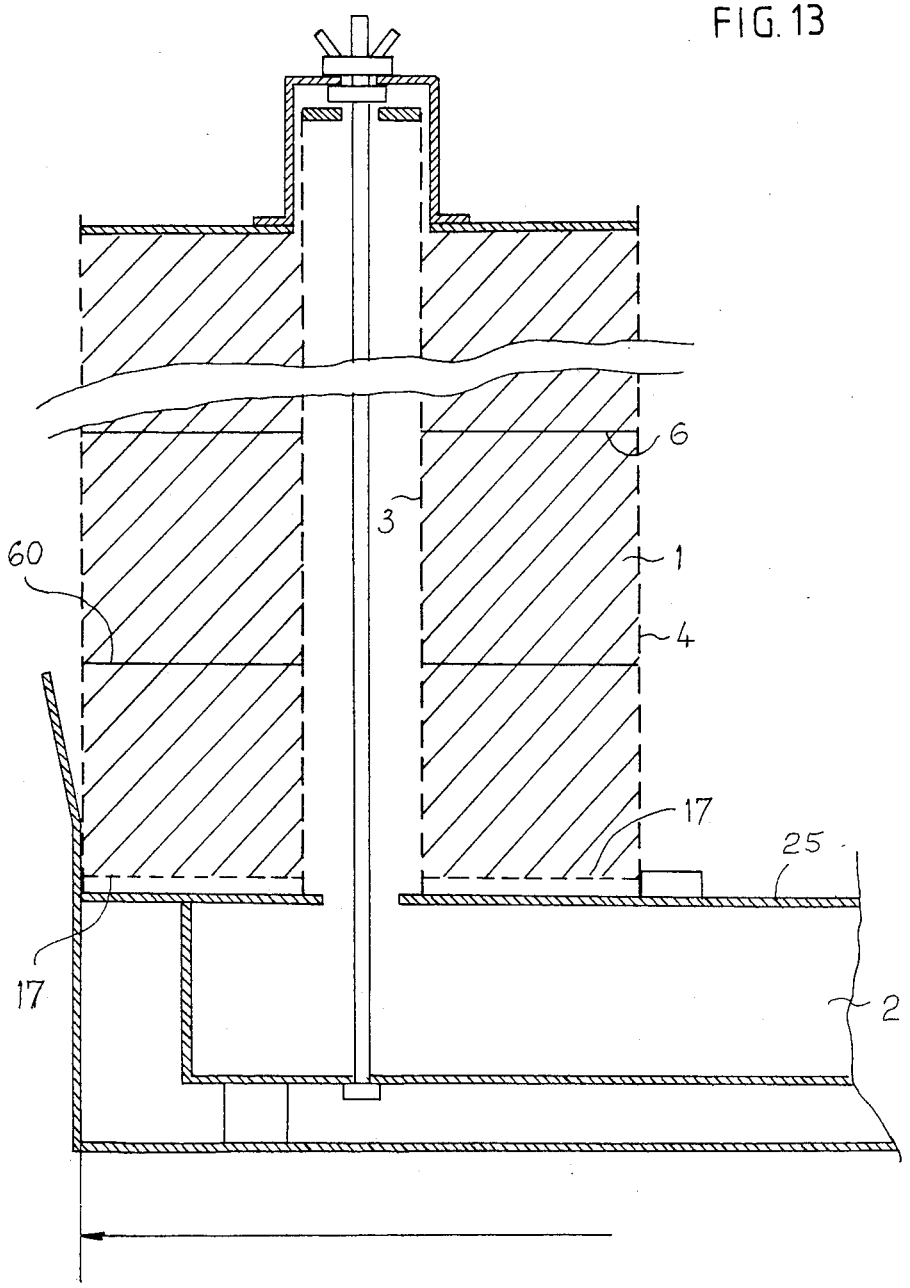

FIGS. 12 and 13 show variations of the supports which receive the fibrous material in piles of spools and a plurality of which forms a material carrier.

According to the variation shown in FIG. 12, the inner sleeve 3 which carries the pile of spools 1 is not integral with the base disk 17, itself integral with the upper force 25 of caisson 2, whereas the outer sleeve 4 is integral with the base disk 17A. The result is that, during the spin-drying operation, sleeve 3 is urged by the centrifugal force to move laterally outwardly and to come to bear against the fibrous material which forms the pile of spools which it carries, which improves the mechanical strength of sleeve 3, whereas the force which it exerts on the pile of spools 1, against which it bears contributes to further improving the spin-drying of the fibrous material inserted between sleeve 3 and sleeve 4.

According to the variation shown in FIG. 13, in which the support comprises an inner sleeve 3 and an outer sleeve 4 integral with the base disk 17, between which is inserted a pile of spools 1, insert disks 60 are interposed between the superimposed spools of a pile 1; the purpose of these disks is also to improve the mechanical strength of the inner sleeve 3.

Figure 15:
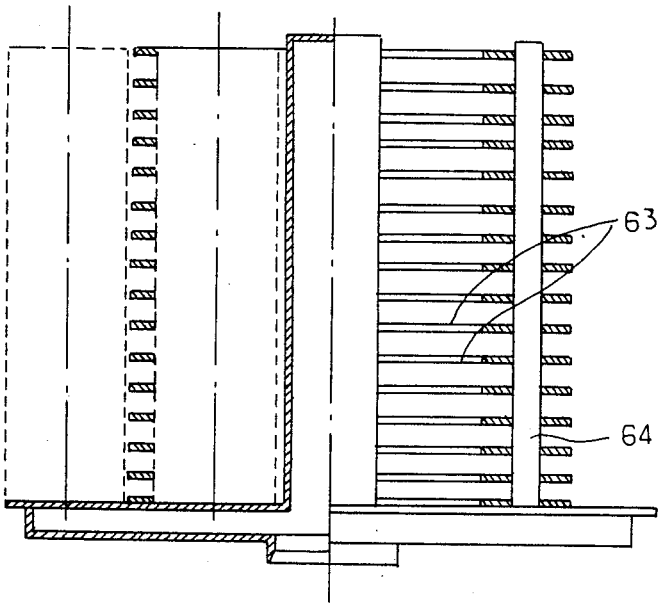
FIG. 15 is a longitudinal sectional view along XV—XV of FIG. 14.
Figure 14:
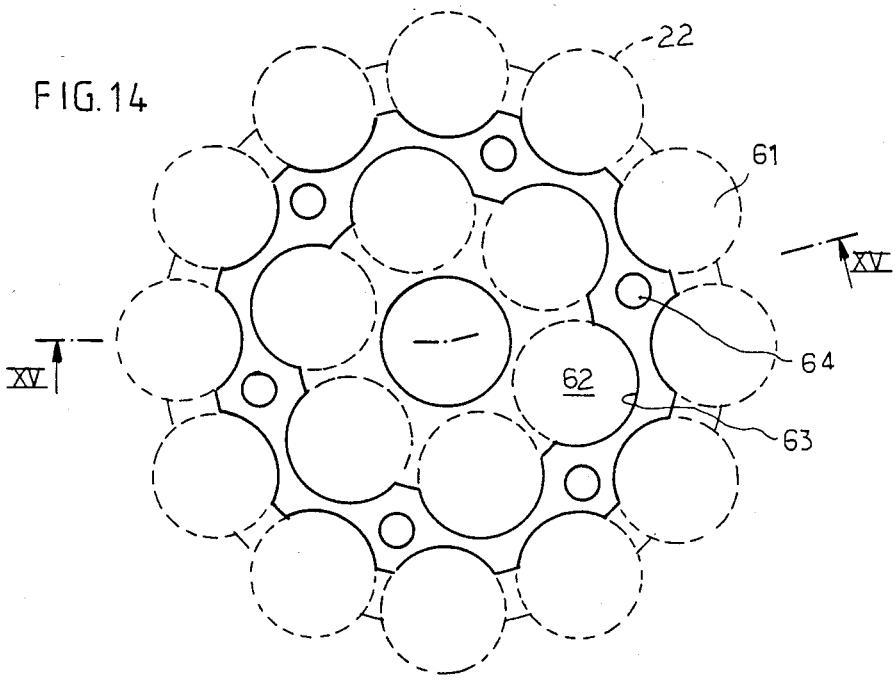
FIG. 14 is a cross sectional view of a variation of the material carrier in accordance with the invention comprising two concentric rings of supports housed respectively, in accordance with the invention, in the basket of the spin-drier and in a series of inner pockets.

FIGS. 14 and 15 show another variation of the supports of the material carrier in accordance with the invention.

According to this variation, the supports of the material carrier are formed by tubes 61,62 disposed in two concentric rings (or more).

During the spin-drying or spin-drying/drying operation by centrifugation, the tubes 61 of the outer ring position themselves in the pockets 11 of the basket of the spin-drier whereas tubes 62 of the inner ring position themselves in pockets formed by a succession of disks 63 spaced apart along support rods 64, which pockets are adapted to withstand the dynamic stress due to the centrifugal force. This variation is more particularly suitable, although not limitatively so, to spin-drying or spin-drying/drying textiles in the form of fiber flock.

Figure 16:
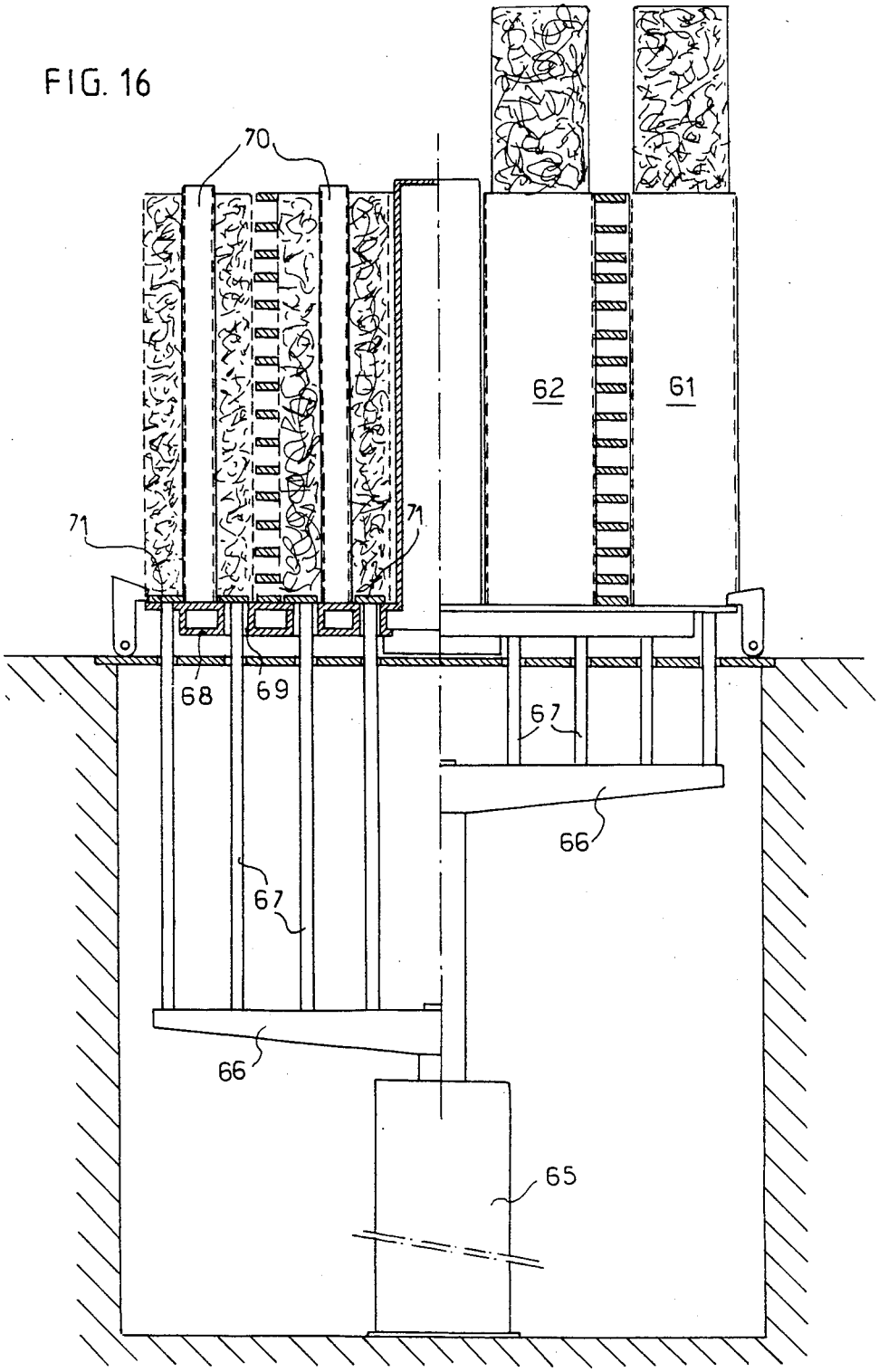
FIG. 16 is a schematical front view of a material unloading device housed in the supports of the material carrier shown in FIGS. 14 and 15.

FIG. 16 shows an advantageous embodiment of the device for unloading the treated textile material, for a spin-drying or spin-drying/drying installation in accordance with the invention, which is particularly well adapted to unloading textile material, more especially in the form of fiber flock, from the tubes which form the material carrier shown in FIGS. 14 and 15.

This unloading device comprises a hydraulic cylinder means 65 which carries at its upper end a plate 66 which supports a plurality of thrust rods 67, whose number is advantageously equal to that of the tubes 61,62 of the material carrier. The caisson 68 of the material carrier is pierced with tubed holes 69 at right-angles to the axes 70 of tubes 61,62 for passing the thrust rods therethrough. The bottoms 71 of tubes 61,62 are in the form of pusher disks adapted to move with an ascending movement in said tubes, under the advancing action of piston 65 with plate 66 and thrust rods 67 which are integral therewith, and to remove, by thrusting during their ascending movement, the textile material, more especially in the form of fiber flock, contained in each of tubes 61,62. During the ascending movement of piston 65 and of parts 66 and 67 which are integral therewith, the material carrier is secured against motion by hooks 72.

Although the pockets 22 of basket 11 have been shown in the drawings with a circular section for receiving piles of spools 1, it will be readily understood that said pockets may have any other appropriate desired cross section, and more especially polygonal, particularly in the case where the pocketed basket in accordance with the invention is provided for treating materials other than fibrous materials such as cellulose textiles or fibers, for example. Thus, in the application of the pocketed basket in accordance with the invention, for treating metal parts, waste or other solid materials, the pockets have advantageously a polygonal shape adapted to allow them to receive containers loaded with the materials to be treated.

As it follows from what has gone before, the invention is in no wise limited to those of its embodiments and modes of application which have just been described more explicitly; it embraces, on the contrary, all the variations thereof which may occur to a technician skilled in the art without departing from the scope and spirit of the present invention.

We claim:

1. In an installation for the centrifugal spin-drying of fibrous or porous materials which comprises, in combination, a spin-drier and a material carrier for receiving at least one pile of spools of fibrous or porous materials said material carrier formed from a plurality of supports each adapted to receive a pile of spools, disposed along at least one ring about a common axis formed by a central caisson, said spin-drier being equipped with a basket for receiving said material carrier, said basket comprising a plurality of pocket means each adapted to receive a pile of spools carried by a support of the material carrier, said supports being adapted to be each housed in a pocket means of the basket of said spin-drier and the common axis about which said supports are disposed in a ring is formed by a hollow central caisson adapted to fit onto a central pivot of the centrifugal spin-drier.

2. The centrifugal spin-drier installation as claimed in claim 1, in which the material carrier comprises at its base a distribution caisson, wherein each support is provided at its lower end with a disk having therethrough a central aperture which cooperates with an axial rod or similar fixed to the bottom of said caisson which extends over the whole height of said support and is integral at its upper end with an assembly formed by a holding element pierced with an aperture for passing said rod therethrough, which is maintained in place by holding means which is locked against said holding element.

3. The centrifugal spin-drying installation as claimed in claim 2, wherein said holding means comprises a plate which is applied to the upper end of the material carried by said support and which comprises an aperture for passing therethrough the upper end of the inner sleeve and the axial rod, closed by a cap associated with a means for locking the upper end of said rod in position.

4. The centrifugal drying installation as claimed in claim 3, wherein each support of the material carrier further comprises two concentric perforated cylinders—or sleeves—between which is disposed a pile of spools and in which said rod or similar forms the axis.

5. The centrifugal spin-drying installation as claimed in claim 3, wherein each support of the material carrier comprises a perforated cylinder or sleeve in which said rod or the like forms the axis about which is disposed a pile of spools.

6. The centrifugal spin-drying installation as claimed in claim 5, wherein the assembly formed by the base disk, the holding element and the axial rod are associated with at least one sleeve, which assembly forms said support, forms a flexible assembly which presses the fibrous or porous material carried by said support against the upper wall of the distribution caisson and allows lateral movement of each support within predetermined controlled limits toward the wall of the corresponding pocket of the basket of the spin-drier in which it is housed, under the effect of the centrifugal force.

7. The centrifugal spin-drying installation as claimed in claim 6, of the type in which the material carrier is formed from a plurality of supports disposed along two or more rings, wherein only the piles of spools carried by the supports of the outer ring are received in the pockets or similar of said basket.

8. The centrifugal spin-drying installation as claimed in claim 6, wherein one or more insert disks substantially parallel to said base disk is/are interposed between the superimposed spools of a pile of spools inserted between said sleeves.

9. The centrifugal spin-drying installation as claimed in claim 6, wherein the inner sleeve is not integral with the base disk and moves laterally outwardly, under the effect of the centrifugal force which is exerted during the spin-drying procedure, independently of the base disk, to come to bear against the inside of the spools of fibrous or porous material inserted between said sleeves.

10. The installation for the centrifugal spin-drying of fibrous or porous materials as claimed in claim 8, further comprising at least one means for holding at least one ring of piles, adapted to confer on the piles of said ring a good resistance to the centrifugal spin-drying force and to avoid deformation thereof.

11. The centrifugal spin-drying installation as claimed in claim 10, wherein said means for holding at least one ring of piles is formed by a belt.

12. The centrifugal spin-drying installation as claimed in claim 11, wherein a belt is positioned about at least one of the inner rings of piles.

13. The centrifugal spin-drying installation as claimed in claim 11, wherein a belt is positioned about at least one inner ring of the piles and a belt is positioned about an outer ring of the piles.

14. The centrifugal spin-drying installation as claimed in claim 11, wherein said belt is provided with an appropriate locking device for temporarily interlocking same with the material carrier.

15. The centrifugal spin-drying installation as claimed in claim 11, including belts for holding the inner ring or rings of piles and a peripheral ring, said ring or ring of piles and said peripheral ring being interlocked to form a unit assembly.

16. The centrifugal spin-drying installation as claimed in claim 11, wherein the holding belt or belts are irremovably secured to said material carrier.

17. The centrifugal spin-drying installation as claimed in claim 10, wherein said means for holding at least one ring of piles is formed by at least one disk comprising apertures for receiving the piles of one or more concentric rings.

18. The centrifugal spin-drying installation as claimed in claim 17, further comprising both at least one belt and at least one holding and centering disk.

19. The centrifugal spin-drying installation as claimed in claim 10, further comprising means adapted to provide drying at the same time as spin-drying of the fibrous or porous materials, which comprise means for introducing and for causing gaseous drying fluid to flow in the spin-drying installation, means for orientating the flow direction of the drying fluid in the spin-drying installation and means adapted to ensure sealing of the spin-drying installation, which cooperate with the means for orientating the flow direction of the drying fluid so as to allow said fluid to flow in the spin-drying installation respectively during the centrifugal rotation of said installation and when said installation is stopped.

20. The centrifugal spin-drying installation as claimed in claim 19, wherein the means adapted for providing drying at the same time as spin-drying of the fibrous or porous materials, comprise first sealing means which ensure the sealing of the spin-drying installation during rotation thereof and second sealing means which ensure sealing of said installation when it is stopped.

21. The centrifugal spin-drying installation as claimed in claim 20, wherein said first sealing means is formed by hydraulic seals.

22. The centrifugal spin-drying installation as claimed in claim 20, wherein said second sealing means are formed by inflatable toric means.

23. The centrifugal spin-drying installation as claimed in 22, wherein said means adapted for providing drying at the same time as spin-drying further comprise means for boosting the pressure of the drying fluid.

24. The centrifugal spin-drying installation as claimed in claim 22, wherein said means adapted for providing drying at the same time as spin-drying further comprise means for placing the drying fluid under a reduced pressure.

25. The centrifugal spin-drying installation as claimed in claim 19, wherein said drying fluid flow means are formed, in combination, by a pressure boosting or depressurizing device and by the rotational drive of the spin-drying installation.

26. The centrifugal spin-drying installation as claimed in claim 19, wherein said means for orientating the flow direction of the drying fluid are formed by a plurality of flaps movable in two positions, mounted on a pivoting axis, disposed in the drying fluid introduction means.

27. The centrifugal spin-drying installation as claimed in claim 19, wherein said means for introducing the drying fluid into the spin-drying installation open into the bottom thereof, in the distribution caisson of this latter.

28. The centrifugal spin-drying installation as claimed in claim 19, wherein said means for introducing the drying fluid into the spin-drying installation open into the lid of this latter.

29. The centrifugal spin-drying installation as claimed in claim 19, wherein said means adapted for providing drying at the same time as spin-drying further comprise means for removing the humidity charged drying fluid from the spin-drying installation, which fluid removal means communicate with said fluid introduction and flow means for recirculation of said fluid in these latter, after passing through a condenser and through pressurizing or depressurizing means.

30. The centrifugal spin-drying installation as claimed in claim 1, comprising a material carrier formed from a plurality of supports for the material to be spin-dried, disposed in two or more concentric rings, wherein said supports are formed by two or more rings of tubes for each receiving a load of material to be spin-dried, the tubes of the outer ring being housed, during the spin-drying operation by centrifugation, in the pockets of the basket and the tubes of the or of each inner ring positioning themselves in pockets formed on the material carrier by a succession of disks spaced apart along support rods.

31. The centrifugal spin-drying installation as claimed in claim 1, wherein said basket comprises a plurality of pockets having an appropriate cross section, such as a circular, polygonal or similar cross section, more especially.

32. The application of a spin-drying basket as claimed in claim 1, to the treatment of any solid materials, and more especially metal parts, waste and other solid materials loaded into containers housed in said pockets.

33. The centrifugal spin-drying installation as claimed in claim 1, wherein loading of the fibrous or porous material on to the material carrier is achieved in the loading station by means of a centering device formed by a trough whose diameter is substantially equal to the diameter d of the material carrier and whose upper part is widened into the form of a cone to a diameter slightly greater than the inner diameter D of the basket of the spin-drier, which centering device is adapted to receive the distribution caisson which forms the base of the material carrier and to cooperate with a stop integral with the upper wall of said caisson for controlling the diameter of the piles of spools loaded on to the material carrier and to reduce it to the diameter d of the material carrier, before introducing this latter into a treatment enclosure.

34. The installation as claimed in claim 1, further comprising a device for unloading the material from the material carrier, which unloading device comprises at least one piston and cylinder device which carries at its upper end a plate on which are placed thrust rods said unloading device cooperating with the material carrier, by introduction of the thrust rods into said latter through tubed holes provided substantially at right-angles to the axes of said tubes, said tubes being equipped with bottoms formed by push disks adapted to move with an ascending movement in said tubes, under the action of said thrust rods, for removing the material contained in said tubes.

35. An apparatus for treating fibrous materials comprising rotor means, means on said rotor means for retaining the material to be treated, a casing member surrounding the rotor means, said casing member being in fluid communication with the material retained by said retaining means, inlet means associated with said casing means for permitting fluid to enter into the casing member during spinning so as to treat said material, exit means associated with said casing member for removing the fluid after treatment, seal means for sealing said casing during and after rotation and means for orienting the flow of fluid from said inlet means and through said outlet means during rotation in cooperation with said seal means and reversing the flow of fluid when rotation is stopped.

* * * * *